US011525369B2

(12) United States Patent
Mairhanser et al.

(10) Patent No.: US 11,525,369 B2
(45) Date of Patent: Dec. 13, 2022

(54) VARIABLE TURBOMACHINE VANE

(71) Applicant: MTU Aero Engines GmbH, Munich (DE)

(72) Inventors: Vitalis Mairhanser, Sigmertshausen (DE); Manuel Hein, Karlsfeld (DE); Axel Stettner, Dachau (DE)

(73) Assignee: MTU Aero Engines AG, Munich (DE)

( * ) Notice: Subject to any disclaimer, the term of this patent is extended or adjusted under 35 U.S.C. 154(b) by 409 days.

(21) Appl. No.: 16/202,426

(22) Filed: Nov. 28, 2018

(65) Prior Publication Data

US 2019/0178100 A1 Jun. 13, 2019

(30) Foreign Application Priority Data

Dec. 7, 2017 (DE) ..... 102017222205.0

(51) Int. Cl.
*F01D 17/16* (2006.01)
*F04D 29/56* (2006.01)
*F01D 9/04* (2006.01)

(52) U.S. Cl.
CPC ..... *F01D 17/16* (2013.01); *F01D 9/042* (2013.01); *F01D 17/162* (2013.01); *F04D 29/563* (2013.01); *F05D 2240/128* (2013.01); *F05D 2240/90* (2013.01); *F05D 2260/79* (2013.01)

(58) Field of Classification Search
CPC ..... F01D 9/02; F01D 17/16; F01D 17/162; F01D 17/165; F04D 29/563; F05D 2240/90; F05D 2240/128; F05D 2260/79
See application file for complete search history.

(56) References Cited

U.S. PATENT DOCUMENTS

| | | | | |
|---|---|---|---|---|
| 5,035,573 | A | 7/1991 | Tseng et al. | |
| 5,492,446 | A | 2/1996 | Hawkins et al. | |
| 6,843,638 | B2 | 1/2005 | Hidalgo | |
| 8,087,883 | B2 | 1/2012 | Bouru et al. | |
| 8,491,257 | B2 * | 7/2013 | Martin | F01D 17/162 415/163 |
| 2017/0030223 | A1 | 2/2017 | Parry et al. | |

(Continued)

FOREIGN PATENT DOCUMENTS

| | | | | |
|---|---|---|---|---|
| DE | 4036693 | A1 | 9/1991 | |
| DE | 102009009079 | A1 * | 8/2010 | F01D 17/162 |
| EP | 3333374 | | 6/2018 | |

(Continued)

*Primary Examiner* — Christopher R Legendre
(74) *Attorney, Agent, or Firm* — Davidson, Davidson & Kappel, LLC

(57) ABSTRACT

A vane assembly for a turbomachine includes a variable vane (10-15), the vane having at least one first, in particular plane or curved, engagement surface (11; 11') for clamping, in particular without play, an actuator (20) of the vane assembly for adjustment of the vane, this first engagement surface not being inclined toward a longitudinal axis (L) of the vane or being inclined toward it by no more than 15°, and/or the vane assembly including a clamp (30; 31) for clamping the actuator against the first engagement surface by at least partially elastically compressing the clamp transversely to the longitudinal axis of the vane and/or by advancing the clamp in a clamp direction (S) that forms an angle of at least 45° with the longitudinal axis of the vane.

21 Claims, 5 Drawing Sheets

(56) References Cited

U.S. PATENT DOCUMENTS

2019/0178100 A1* 6/2019 Mairhanser ..... F01D 17/162

FOREIGN PATENT DOCUMENTS

| | | | |
|---|---|---|---|
| FR | 2879685 | | 6/2006 |
| FR | 2904669 | A1 | 2/2008 |
| GB | 2060782 | | 5/1981 |
| GB | 2280484 | A | 2/1995 |
| WO | WO2009076508 | | 6/2009 |

* cited by examiner

VARIABLE TURBOMACHINE VANE

This claims the benefit of German Patent Application DE 10 2017 222205.0, filed Dec. 7, 2017 which is hereby incorporated by reference herein.

The present invention relates to a vane assembly including a variable vane for a turbomachine, a turbomachine assembly including the vane assembly, as well as a vane and an actuating means for the vane assembly, and a method for mounting the same.

BACKGROUND

From in-house practice, gas turbines are known which have variable stator vanes, whose vane stems extend through bearing openings in the turbomachine casing. Actuating levers are placed onto these vane stems in the longitudinal or axial direction thereof and clamped by nuts against shoulders of the vane stems in the longitudinal direction.

In the case of slender vane stems, in particular, the diameters of such shoulders are disadvantageously reduced due to the minimum thread diameter required for tightening the nuts.

SUMMARY OF THE INVENTION

It is an object of an embodiment of the present invention to improve turbomachines having variable vanes and/or the mounting thereof.

In an embodiment of the present invention, a vane assembly for a turbomachine, in particular at least one vane assembly of a turbomachine assembly, in particular (at least) one vane assembly for a, or of at least one, compressor or turbine stage for, or of, a gas turbine, in particular for, or of, an aircraft engine has a vane that is, or is adapted or used to be, adjustably, in particular rotatably, mounted on, in particular in, the turbomachine assembly.

In an embodiment, the vane is a stator vane and/or has an airfoil or profiled portion for flow deflection and/or a single-piece or multi-piece vane stem which, in an embodiment, is, or is adapted or used to be, adjustably, in particular rotatably, mounted on, in particular in, the turbomachine (assembly). Such vanes constitute particularly advantageous applications of the present invention.

In an embodiment of the present invention, the vane, in particular its vane stem, has at least one first, in particular plane or curved, engagement surface with which or against which an actuating means of the vane assembly, which actuating means allows, or is adapted or used to allow, the vane to be adjusted, is, or is adapted or used to be, clamped, in particular pressed, in particular form-fittingly and/or contactingly and/or without play.

In an embodiment, a curved, in particular convex, engagement surface advantageously allows for self-centering. In an embodiment, a plane engagement surface advantageously makes it possible to improve force transmission.

In an embodiment of the present invention, the first engagement surface is not inclined toward a longitudinal axis, in particular axis of adjustment or rotation, of the vane, in particular of the vane stem, or is inclined toward it by no more than 15°, in particular no more than 10°, in one embodiment no more than 5°.

Additionally or alternatively, in an embodiment of the present invention, the vane assembly includes a single-piece or multi-piece clamping means. In an embodiment, the actuating means is clamped, in particular pressed, against the first engagement surface through or by partially or fully elastic compression of the clamping means in a direction transverse to the longitudinal axis of the vane and, in an embodiment, additionally or alternatively, by advancing, in particular extending and/or displacing, in particular tightening or mounting, the clamping means in a clamping means direction; i.e., the clamping means clamps, in particular presses, or is adapted or used to clamp, in particular press, the actuating means against the first engagement surface when at least partially elastically compressed transversely to the longitudinal axis of the vane and/or advanced, in particular extended and/or displaced, in particular tightened or mounted, in the clamping means direction. In an embodiment, the clamping means direction and the longitudinal axis of the vane form an angle of at least 45°, in an embodiment at least 60°, in particular at least 75°, and in one embodiment at least 85°.

Thus, in an embodiment, the actuating means is no longer, or at least substantially not, clamped in the longitudinal axis direction of the vane or axially with respect to the longitudinal vane axis and/or with a shoulder of the vane, but, rather, at least substantially, perpendicularly or transversely to the longitudinal axis direction or radially with respect to the longitudinal vane axis and/or with or against a lateral engagement surface or longitudinal side of the vane, in particular of the vane stem.

This makes it possible to provide a (larger) engagement surface and thereby in particular reduce the load thereon, and thus to improve the mounting process and/or reliably, especially also in the case of vanes having (more) slender vane stems. In an embodiment, additionally or alternatively, this allows the engagement surface for clamping to function at the same time as a supporting surface for the actuation or adjustment of the vane by the actuating means. In an embodiment, additionally or alternatively, this allows the vane assembly to be designed more compactly in the direction of the longitudinal axis of the vane.

A (partially) elastic compression in a direction transverse to the longitudinal axis of the vane is understood herein in particular as a (partially) elastic, in particular microscopic, shortening or negative elongation $\varepsilon$ of the clamping means, which, in an embodiment, is effected or caused in a form-fitting manner and which, according to the law of elasticity $\sigma=\sigma(E, \varepsilon)$, imposes or causes corresponding clamping forces and strains with the modulus of elasticity E. In an embodiment, the compression is caused by advancing the clamping means in the clamping means direction.

In an embodiment, the vane or vane stem has at least one second, in particular plane, engagement surface with which or against which the actuating means is, or is adapted or used to be, clamped, in particular pressed, in particular form-fittingly and/or contactingly.

In an embodiment, the actuating means is clamped only with or against the first engagement surface and, as the case may be, the second engagement surface; in another embodiment additionally against one or more further engagement surfaces which are spaced apart from the first engagement surface and/or, as the case may be, the second engagement surface, or may merge, in particular smoothly, into (at least one of) the same.

In an embodiment, the second engagement surface is inclined toward the first engagement surface; in an embodiment by at least 30°, in particular by at least 60°, and/or by no more than 120°, in particular by less than 90°. In an embodiment, the actuating element is clamped by the first and second engagement surfaces, in particular thereby, without play, or these are adapted for this purpose.

In an embodiment, the second engagement surface is also not inclined toward the longitudinal axis of the vane or vane stem, or is inclined toward it by no more than 15°, in particular no more than 10°, in one embodiment no more than 5°. Additionally or alternatively, in an embodiment, the actuating means is also clamped, in particular pressed, against the second engagement surface by at least partially elastically compressing the clamping means transversely to the longitudinal axis of the vane and/or by advancing it, and respectively by the clamping means when at least partially elastically compressed transversely to the longitudinal axis of the vane or advanced in the clamping means direction, and the clamping means and the second engagement surface are used or adapted for this purpose.

In an embodiment, this makes it possible to (further) improve the mounting process, stability, loading and/or reliability.

In an embodiment, the first and second engagement surfaces are symmetrical to one another. In an embodiment, this makes it possible to (further) improve the loading.

In another embodiment, the first and second engagement surfaces are not symmetrical to one another. In an embodiment, this makes it possible to (further) improve the mounting process and, in particular, to ensure a unique mounting (orientation). Generally speaking, in an embodiment, the actuating means can be mounted on the vane only in one orientation which is defined, in particular, by a contact geometry.

In an embodiment, the clamping means is in particular non-destructively detachably, in particular form-fittingly and/or frictionally, in particular self-lockingly, secured on, in particular partially in, the actuating means, in particular mounted in the clamping means direction or another direction, in particular introduced into the actuating means, and, in an embodiment, threadedly connected, latched, or wedged thereto and/or pressed thereinto. In an embodiment, the clamping means is secured on, in particular partially in, the actuating means in a manner which does not permit non-destructive detachment, in particular by a material-to-material bond, in particular by welding, brazing and/or adhesive bonding.

In an embodiment, the clamping means may include, in particular be, a screw, in particular a screw threaded in the clamping means direction and/or a screw having a polygonal, in particular square, hexagonal or octagonal, head, or a square-head, hexagonal or octagonal screw, which can be advantageous, in particular, for retention by means of one or more retaining means, which will be described below.

In a refinement, the clamping means may include, in particular be, a wedge and/or bear against a wedge surface of the actuating means and/or a wedge surface of the screw which is inclined toward the longitudinal axis of the vane, so that displacement of this clamping means (also) in the direction of the longitudinal axis of the vane causes the actuating means to be clamped against the vane, in particular the first engagement surface thereof.

Additionally or alternatively, in an embodiment, the clamping means presses against a contact surface of the vane, in particular of the vane stem, which contact surface, in an embodiment is plane, thereby clamping or pressing the actuating means against the vane or vane stem or the first engagement surface and, as the case may be, the second engagement surface.

In an embodiment, (when viewed) in a direction transverse to the longitudinal axis of the vane, the clamping means is disposed, in particular supported, in particular at least part elastically compressed for clamping the actuating means against the vane, between a longitudinal side, in particular contact surface, of the vane and a supporting surface of the actuating means which supporting surface is located opposite, in particular (as viewed) in a direction transverse to the longitudinal axis of the vane, in an embodiment by bearing on a wedge surface of the actuating means and/or a wedge surface of the screw that is inclined toward the longitudinal axis of the vane.

In an embodiment, the actuating means may include, in particular be, an actuating lever. In an embodiment, the actuating means or lever has at least one point which, when the actuating means is mounted on the vane, is maximally distant from the longitudinal axis of the vane or vane stem, a line normal or perpendicular to the longitudinal axis and extending from the longitudinal axis to this point defining a (direction of) maximum extent of the actuating means or lever (away from the vane) in accordance with the present invention.

In an embodiment, the clamping means and this direction of maximum extent of the actuating means are located in the same half-circle sector, in particular the same quarter-circle sector, or in the same circular sector of 180°, in particular 90°, (as viewed) in the circumferential direction about the longitudinal axis of the vane. Thus, in an embodiment, the clamping means is disposed, in particular threaded into the actuating means, at least substantially in the direction of maximum extent thereof.

In an embodiment, this makes it possible to save space in the direction of the longitudinal axis and/or to (further) improve the mounting process.

In another embodiment, the clamping means and this direction of maximum extent of the actuating means away from the vane are located in opposed half-circle sectors, in particular quarter-circle sectors, or in opposed circular sectors of 180° each, in particular 90° each, which are angularly offset from one another by 180° in the circumferential direction, (as viewed) in the circumferential direction about the longitudinal axis of the vane. Thus, in an embodiment, the clamping means is disposed, in particular threaded into the actuating means, at least substantially in a direction opposite to the direction of maximum extent thereof.

In an embodiment, this makes it possible to save space on the side opposite the direction of maximum extent.

In another embodiment, the clamping means and the direction of maximum extent of the actuating means away from the vane are located in half-circle sectors, in particular quarter-circle sectors, or in circular sectors of 180° each, in particular 90° each, which are angularly offset from one another by 90° in the circumferential direction, (as viewed) in the circumferential direction about the longitudinal axis of the vane.

In an embodiment, this makes it possible to save space in the direction of the longitudinal axis and on the side opposite the direction of maximum extent and/or to (further) improve the mounting process.

In an embodiment, the vane assembly has a retaining means arrangement including one or more retaining means which prevent(s), or is/are adapted or used to prevent, the clamping means in particular from becoming loose, in particular one or more retaining means for retention through form-fit and/or one or more retaining means for frictional retention.

In an embodiment, at least one retaining means of the retaining means arrangement is, or is adapted or used to be, threadedly mounted to the actuating means and/or clamping means. In a refinement, such a retaining means may include, in particular be, a self-locking threaded insert that is threadedly mounted to the actuating means and the clamping means.

Additionally or alternatively, at least one retaining means of the retaining means arrangement is, or is adapted or used to be, plastically deformed and/or resiliently held between the clamping means and the actuating means and/or formed integrally with the clamping means. In a refinement, such a retaining means may include, in particular be, a sheet-metal retainer.

In an embodiment, this makes it possible to (further) improve the mounting process, stability, loading and/or reliability.

In an embodiment, the vane assembly includes at least one positioning means attached, in particular detachably, to the vane and/or the actuating means and/or at least one, in particular integrally formed or undetachably attached, projection on the vane and/or the actuating means, which causes, or is adapted or used to cause, the actuating to be axially positioned, in particular form-fittingly and/or frictionally, on the vane in the direction of its longitudinal axis.

In an embodiment, the, or at least one, retaining and positioning means are formed integrally with one another. In a refinement, the, or at least one, sheet-metal retainer serves at the same time as an axial positioning means.

In an embodiment, the vane, in particular its vane stem, has at least one depression, which is, or is adapted or used to be, engaged by the clamping means.

Additionally or alternatively, in an embodiment, the vane, in particular its vane stem, has at least one depression, which is, or is adapted or used to be, engaged by the at least one retaining and/or positioning means.

In an embodiment, the actuating means has a cutout or inner surface which is, or is adapted or used to be, clamped against the first engagement surface and/or the second engagement surface of the vane or vane stem.

In an embodiment, this makes it possible to (further) improve the mounting process, stability, loading and/or reliability, respectively, in particular in combination.

In a refinement, the cutout of the actuating means for clamping against the first engagement surface and/or the second engagement surface of the vane is formed open at both ends or as a through-opening, in an embodiment by electrochemical machining and/or electric discharge machining.

In an embodiment, this makes it possible to (further) improve the production and/or mounting thereof.

In another refinement, the cutout of the actuating means for clamping against the first engagement surface and/or the second engagement surface of the vane is formed closed at one end or open at one end (only), in an embodiment by electrochemical machining and/or electric discharge machining.

In an embodiment, this makes it possible to form, on the vane, a particularly reliable stop for the axial positioning of the actuating means on the vane in the direction of its longitudinal axis.

In an embodiment, the first engagement surface and/or the second engagement surface of the vane project(s) or protrude(s) from the cutout of the actuating means at one or both ends.

In an embodiment, this makes it possible to improve the mounting process, in particular to compensate for tolerances.

BRIEF DESCRIPTION OF THE DRAWINGS

Further advantageous refinements of the present invention will become apparent from the following description of preferred embodiments. To this end, the drawings show, partly in schematic form, in.

DETAILED DESCRIPTION

Figure 2:
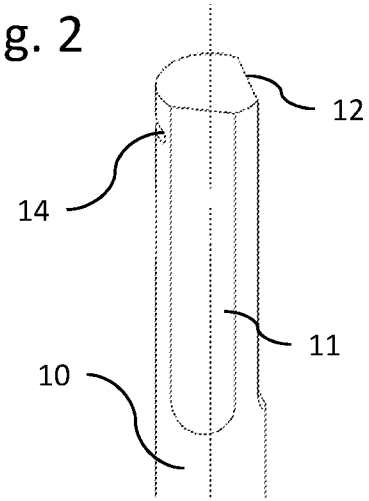
FIG. 2: a perspective detail view of the vane.
Figure 3:
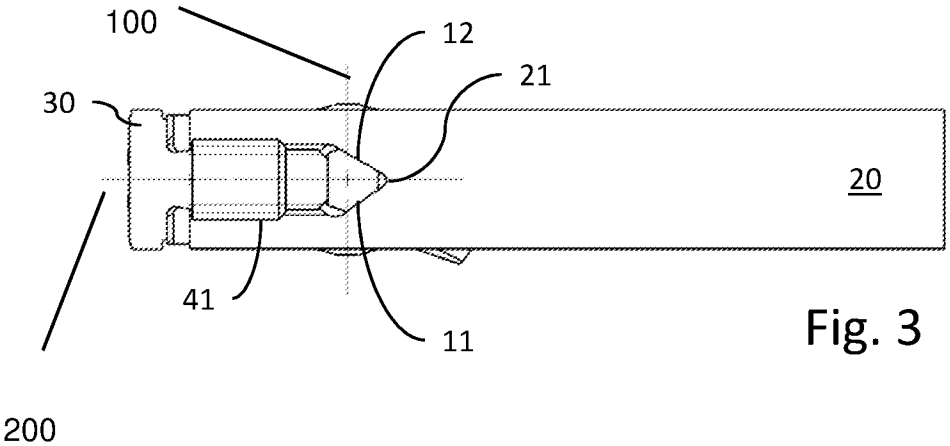
FIG. 3 a sectional view along A-A of FIG. 1.
Figure 1:
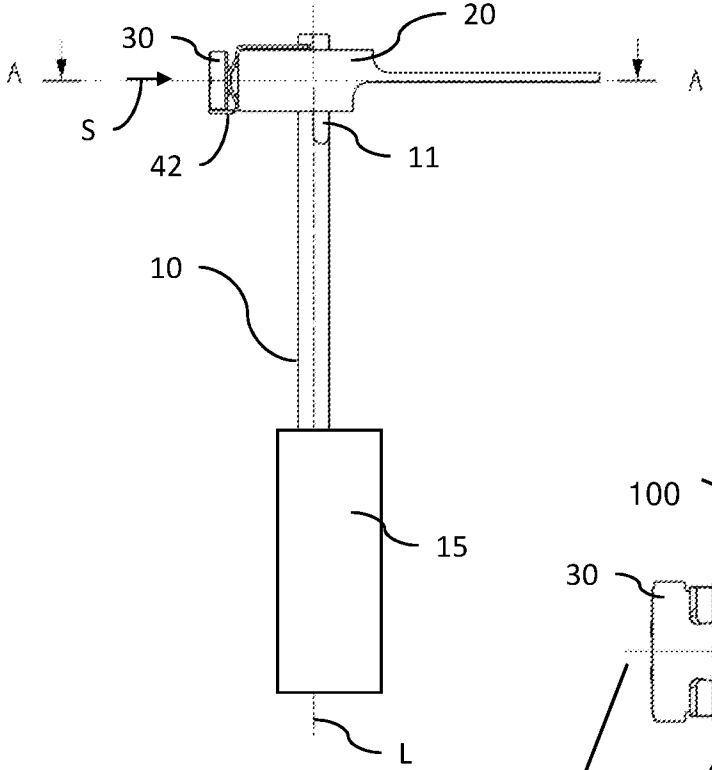
FIG. 1: a side view of a vane assembly including a variable vane and an actuating means according to an embodiment of the present invention.

FIGS. 1-5 show a vane assembly including a variable vane and an actuating means 20 according to an embodiment of the present invention in a side view (FIG. 1), a plan view (FIG. 4), and sectional views (FIGS. 3, 5), and also the vane in a perspective detail view (FIG. 2).

The vane includes an airfoil 15 and a vane stem 10 which is, or is intended to be, mounted in a casing of a compressor or turbine stage so as to be rotatable about a longitudinal axis L of the vane or vane stem. This is generally known and, therefore, will not be further described herein.

The vane or vane stem have a first engagement surface 11 and a second engagement surface 12 symmetrical thereto, the two engagement surfaces being inclined toward one another, in the exemplary embodiment by about 70°.

In the exemplary embodiment, both engagement surfaces are parallel to longitudinal axis L; i.e., not inclined toward it. In a modification, the two engagement surfaces 11, 12 are not symmetrical to one another and/or slightly inclined toward longitudinal axis L.

Figure 5:
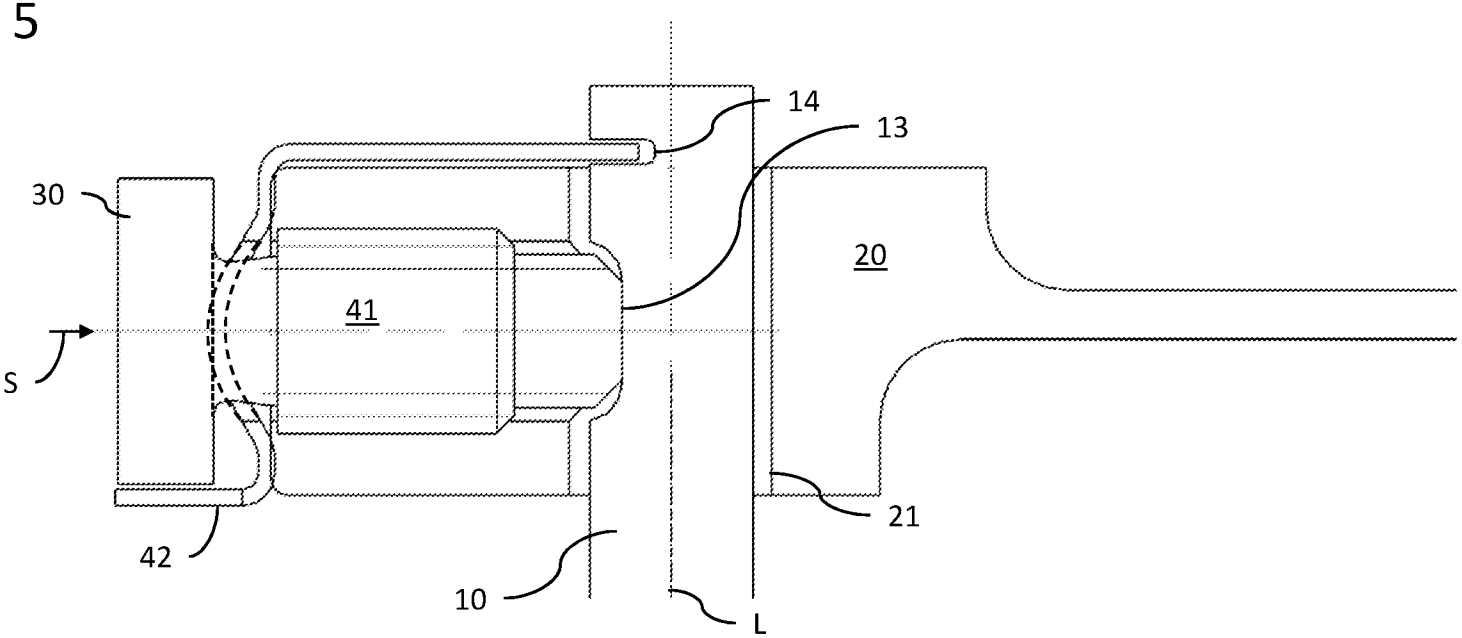
FIG. 5 a sectional view along B-B of FIG. 4.

On the side opposite the two engagement surfaces 11, 12, the vane or vane stem has a depression having a plane base surface 13 and a slotted groove 14 (see FIG. 5).

Actuating means 20 has a cutout in the form of a through-hole 21, with which it is placed over vane stem 10, so that the vane stem and its engagement surfaces 11, 12 extend through through-hole 21.

A clamping means in the form of a hexagonal screw 30 is threaded into actuating means 20 in a clamping means direction S that is at least substantially perpendicular to longitudinal axis L; i.e., forms an angle of about 90° therewith, (horizontally from left to right in FIGS. 1, 3-5), so that screw 30 engages the depression having the plane base surface 13 and presses against the base surface in clamping means direction S, thereby pulling actuating means 20 against engagement surfaces 11, 12 and clamping or pressing it without play thereagainst, with screw 30 being at least partially elastically compressed transversely to longitudinal axis L of the vane.

Screw 30 is secured in place by a first retaining means in the form of a self-locking threaded insert 41 that is threadedly mounted to or between actuating means 20 and screw 30 and by a second retaining means in the form of a sheet-metal retainer 42, which is partially plastically bent for this purpose.

As can be seen especially in FIG. 5, sheet-metal retainer 42 is resiliently held between the head of screw 30 and actuating means 20, allowing screw 30 to pull actuating means 20 against engagement surfaces 11, 12, thereby clamping them thereagainst. In other words, here, the sheet-metal retainer is flexible to compensate for tolerances.

In addition, sheet-metal retainer 42 engages slotted groove 14, thus axially positioning actuating means 20 on the vane in the direction of its longitudinal axis L. Accordingly, sheet-metal retainer 42 forms an integrally formed retaining and positioning means.

Figure 4:
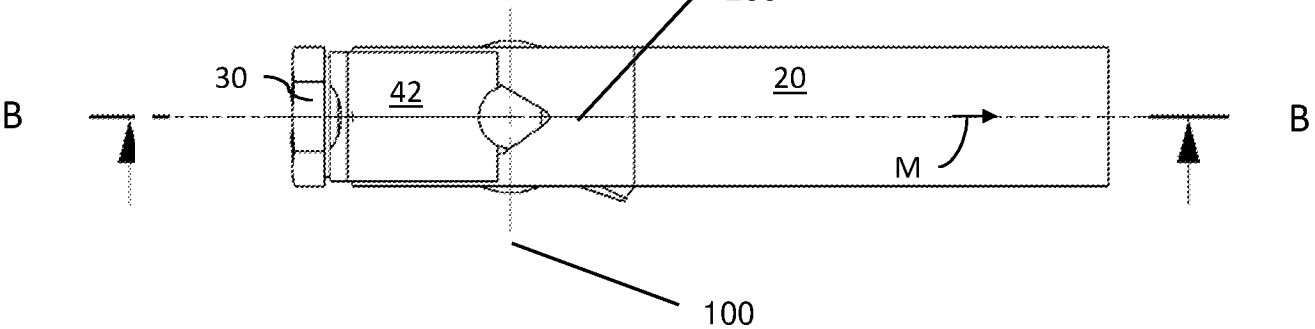
FIG. 4 a plan view of the vane assembly of FIG. 1.
Figure 6:
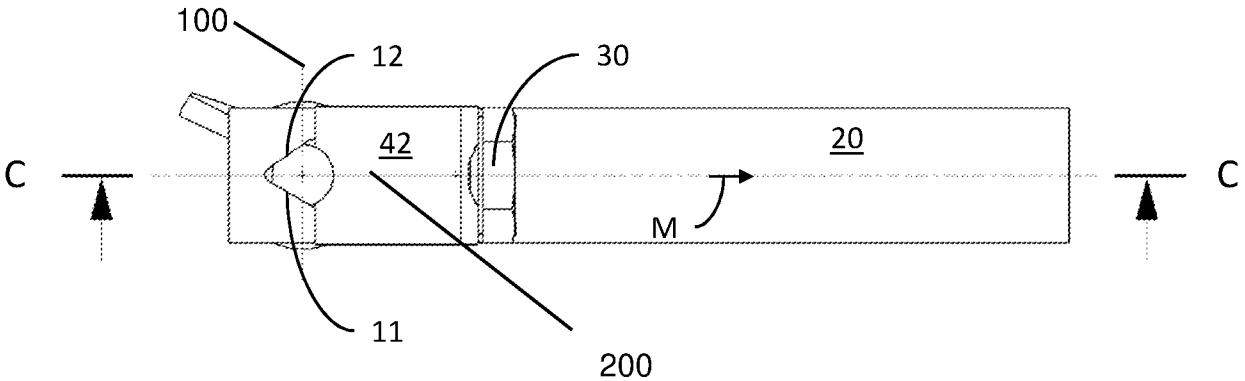
FIG. 6: a plan view, similar to FIG. 4, of a vane assembly including a variable vane and an actuating means according to another embodiment of the present invention.

FIG. 6, 7 show, in views similar to FIGS. 4, 5, a vane assembly according to another embodiment of the present invention. Corresponding features are identified by identical reference numerals, so that reference is made to the preceding description and only the differences will be discussed below.

Actuating means 20 has a direction of maximum extent M away from the vane (horizontally from left to right in FIGS. 4-7).

In FIGS. 3, 4, 6, and 8, lines 100 and 200 together divide the vane stem 10 into quarter-circle sectors, and each of lines 100 and 200 alone divide the vane stem into half-circle sectors.

In the embodiment of FIGS. 4, 5, clamping means 30 and this direction of maximum extent M are located in opposed half-circle sectors, as viewed in the circumferential direction about longitudinal axis L, since screw 30 is threaded into actuating means 20, as it were, from the side opposite the actuating means or the direction of maximum extent thereof.

Figure 7:
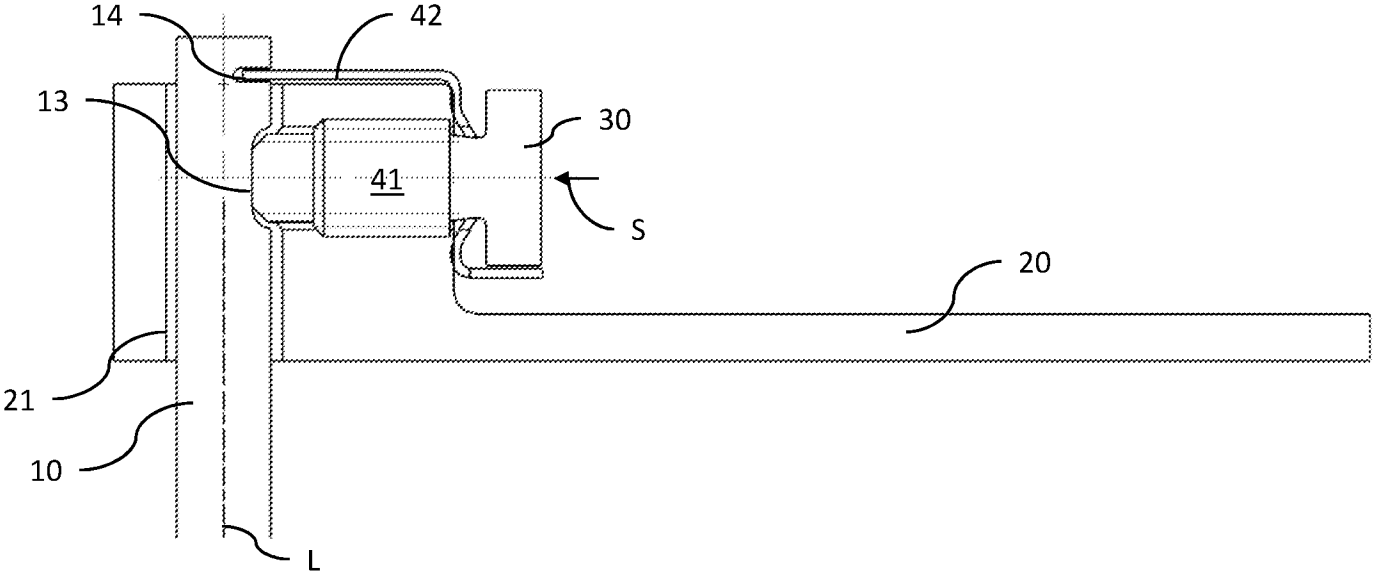
FIG. 7: a sectional view along C-C of FIG. 6.

In contrast, in the embodiment of FIGS. 6, 7 clamping means 30 and direction of maximum extent M are located in the same half-circle sector, as viewed in the circumferential direction about longitudinal axis L, since screw 30 is threaded into actuating means 20, as it were, from the side of the direction of maximum extent thereof.

As illustrated by comparison of FIGS. 5, 7, threaded insertion in a direction opposite to the direction of maximum extent M makes it possible to save space on the left in FIG. 7; threaded insertion in the direction of maximum extent M makes it possible to save space at the top in FIG. 5.

Figure 9:
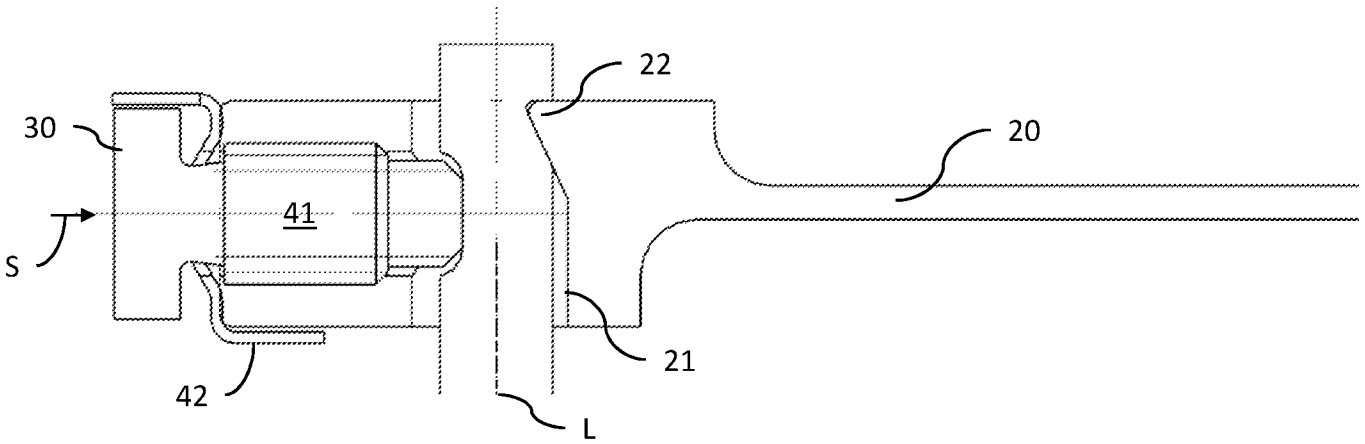
FIG. 9: a sectional view along D-D of FIG. 8.
Figure 8:
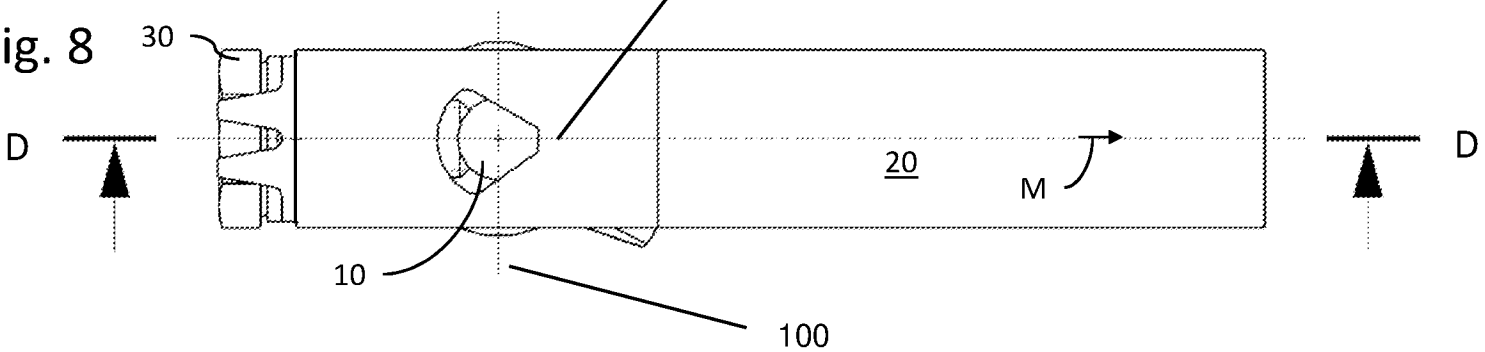
FIG. 8: a plan view, similar to FIGS. 4, 6, of a vane assembly including a variable vane and an actuating means according to a further embodiment of the present invention.

FIGS. 8, 9 show, in views similar to FIGS. 4, 5, a vane assembly according to another embodiment of the present invention. Again, corresponding features are identified by identical reference numerals, so that reference is made to the preceding description and only the differences will be discussed below.

In the embodiment of FIGS. 8, 9, the actuating means has an integrally formed projection 22 in the cutout 21, which is open at both ends, the projection engaging wedge-shaped groove 14 in vane stem 10, whereby actuating means 20 is axially positioned on the vane or its vane stem 10 in the direction of its longitudinal axis L. In modifications (not shown), cutout 21 may also be closed at one end (at the top in FIG. 9), or, conversely, the vane or its vane stem 10 may have a projection for axial positioning.

Figure 11:
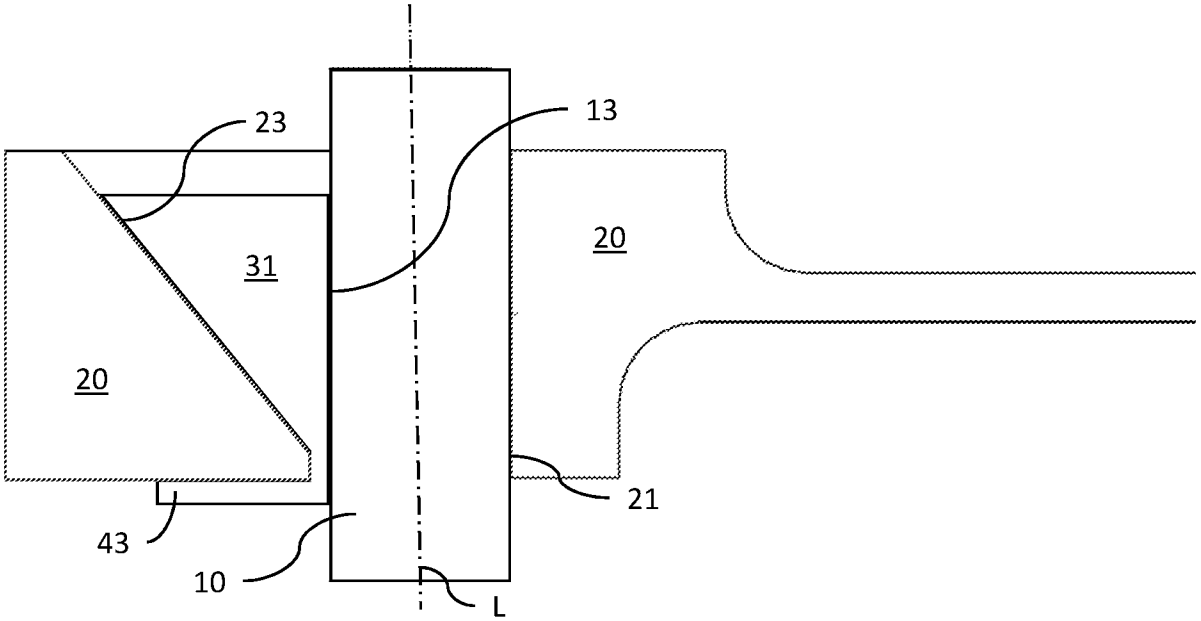
FIG. 11: a sectional view along E-E of FIG. 10.
Figure 10:
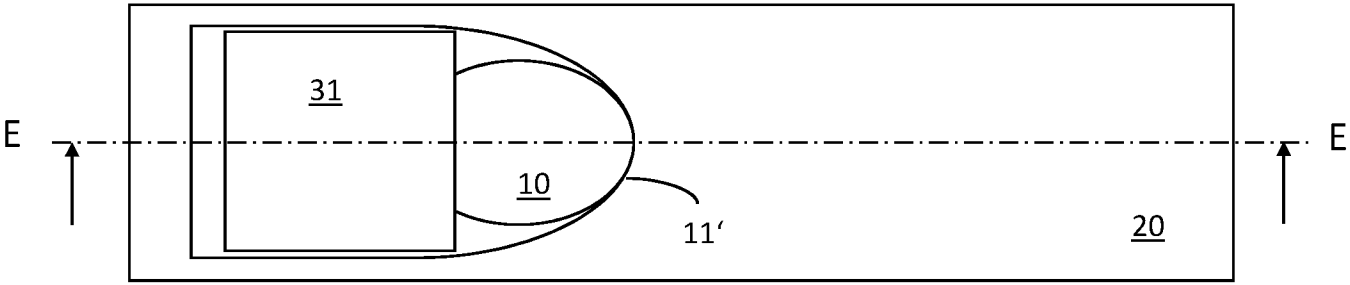
FIG. 10: a plan view, similar to FIGS. 4, 6, 8, of a vane assembly including a variable vane and an actuating means according to yet another embodiment of the present invention.

FIGS. 10, 11 show, in views similar to FIGS. 4, 5, a vane assembly according to another embodiment of the present invention. Again, corresponding features are identified by identical reference numerals, so that reference is made to the preceding description and only the differences will be discussed below.

In the embodiment of FIGS. 10, 11, the clamping means does not take the form of a screw 30, but of a wedge 31 that bears self-lockingly on a wedge surface 23 of actuating lever 20, and is thereby at least partially elastically compressed between this wedge surface 23 and the longitudinal side or contact surface 13 of the vane or vane stem 10 which longitudinal side or contact surface is located opposite the wedge surface in a direction transverse to longitudinal axis L, the wedge thereby clamping the actuating lever against first engagement surface 11', which, in the embodiment of FIGS. 10, 11, is curved.

Formed integrally with wedge 31 is a retaining means in the form of a tab 43 that is plastically bent under the actuating lever to secure the wedge in place.

Although exemplary embodiments have been described hereinabove, it should be understood that many modifications thereof are possible.

For example, the embodiments of FIG. 6-9, in particular, may be combined, or clamping means direction S may, for example, also be perpendicular to the plane of the drawing of FIG. 5, 7 or 9, or be vertical in FIG. 4, 6 or 8.

Similarly, in the embodiment of FIGS. 10, 11, wedge 31 may also be located in the half-circle sector of the direction of maximum extent (see FIG. 6) or a half-circle sector angularly offset by 90° therefrom and/or may additionally or alternatively to integral tab 43 be secured in place by a separate retaining means.

Also, additionally or alternatively to wedge surface 23, the vane stem may also have a wedge surface, so that the actuating lever is clamped against first engagement surface 11' by inserting wedge 31 or a differently shaped clamping means. In a modification, first engagement surface 11' may, additionally or alternatively, also be plane.

In the embodiment of FIGS. 10, 11, due to the acute angle of wedge surface 23, the clamping means direction in which wedge 31 is advanced to clamp actuating lever 20 against first engagement surface 11' forms an angle of less than 45° with longitudinal axis L of the vane.

In a modification (not shown) of the embodiment of FIG. 5 or 7, instead of threading screw 30 in the clamping means direction and at least partially elastically compressing it correspondingly, it is also possible, for example, to use a clamping means that has expanded in the clamping means direction and thereby presses actuating lever 20 against first engagement surface 11'.

It should also be appreciated that the exemplary embodiments are only examples, and are not intended to limit the scope, applicability, or configuration in any way. Rather, the foregoing detailed description provides those skilled in the art with a convenient road map for implementing at least one exemplary embodiment, it being understood that various changes may be made in the function and arrangement of elements described without departing from the scope of protection as is derived from the claims and the combinations of features equivalent thereto.

LIST OF REFERENCE NUMERALS

10 vane stem
11; 11' first engagement surface
12 second engagement surface
13 depression/contact surface
14 groove
15 airfoil

20 actuating means
21 cutout
22 projection
23 wedge/supporting surface
30 screw (clamping means)
31 wedge (clamping means)
41 self-locking threaded insert
42 sheet-metal retainer
43 retaining tab
L longitudinal axis
M direction of maximum extent
S clamping means direction

What is claimed is:

1. A vane assembly for a turbomachine comprising:

a variable vane, the vane having a first engagement, the first engagement surface not being inclined toward a longitudinal axis of the vane or being inclined toward it by no more than 15°;

wherein the vane has a second engagement surface, the second engagement surface being inclined toward the first engagement surface, the second engagement surface not being inclined toward the longitudinal axis of the vane or being inclined toward it by no more than 15°;

and a clamping means for clamping an actuating means against the first engagement surface and the second engagement surface, wherein (i) the clamping means is a screw that is at least partially elastically compressed transversely to the longitudinal axis of the vane and pressed against the actuating means to secure the actuating means to the first engagement surface and the second engagement surface, or (ii) the clamping means is a wedge that is advanced in a clamp direction forming an angle of less than 45° with the longitudinal axis of the vane to secure the actuating means to the first engagement surface and the second engagement surface.

2. The vane assembly as recited in claim 1 wherein the first engagement surface is planar or curved and the actuating means is secured to the first engagement surface without play.

3. The vane assembly as recited in claim 1 wherein the clamping means is said wedge, and said wedge includes an integrally formed tab that is plastically bent under the actuating means to secure said wedge in place.

4. The vane assembly as recited in claim 3 wherein the actuating means has a cutout for clamping against the first engagement surface or the second engagement surface of the vane, the cutout being open at two ends thereof or closed at one of said two ends.

5. The vane assembly as recited in claim 1 wherein the second engagement surface is planar and the actuating means is secured to the first engagement surface without play.

6. The vane assembly as recited in claim 1 wherein the first and second engagement surfaces are symmetrical to one another.

7. The vane assembly as recited in claim 1 wherein the first and second engagement surfaces are not symmetrical to one another.

8. The vane assembly as recited in claim 1 wherein the clamping means is secured on the actuating means non-destructively and detachably.

9. The vane assembly as recited in claim 1 wherein the clamping means is said wedge and said wedge is secured on the actuating means self-lockingly.

10. The vane assembly as recited in claim 1 wherein the clamping means and a direction of maximum extent of the actuating means away from the vane are located in a same half-circle sector or in opposed half-circle sectors in a circumferential direction about the longitudinal axis of the vane.

11. The vane assembly as recited in claim 1 wherein the clamping means and a direction of maximum extent of the actuating means away from the vane are located in a same quarter-circle sector, in opposed quarter-circle sectors, or in quarter-circle sectors angularly offset from one another by 90° in a circumferential direction about the longitudinal axis of the vane.

12. The vane assembly as recited in claim 1 wherein the clamping means is said screw, and further comprising a sheet metal retainer arranged between the actuating means and the clamping means.

13. The vane assembly as recited in claim 12 further comprising a slotted groove in the vane, one end of the sheet metal retainer being received in the slotted groove.

14. The vane assembly as recited in claim 1 wherein the clamping means is said screw, and the screw is secured into place by a self-locking threaded insert.

15. The vane assembly as recited in claim 1 wherein the actuating means includes an integrally formed projection, wherein said projection is received in a groove in the vane, whereby the actuating means is axially positioned on the vane.

16. The vane assembly of claim 1, wherein the second engagement surface is inclined toward the first engagement surface by no more than 120 degrees.

17. The vane assembly of claim 1, wherein the second engagement surface is inclined toward the first engagement surface by less than 90 degrees.

18. A turbomachine assembly comprising a compressor including a plurality of the vane assembly according claim 1.

19. A turbomachine assembly comprising a turbine stage including a plurality of the vane assembly according to claim 1.

20. A vane assembly for a turbomachine comprising:

a variable vane, the vane having a first engagement surface, the first engagement surface not being inclined toward a longitudinal axis of the vane or being inclined toward it by no more than 15°;

the vane assembly including a clamping means for clamping the actuating means against the first engagement surface, wherein the clamping means is a screw that is at least partially elastically compressed, transversely to the longitudinal axis of the vane and pressed against the actuating means to secure the actuating means to the first engagement surface.

21. A vane assembly for a turbomachine comprising:

a variable vane, the vane having a first engagement surface, the first engagement surface not being inclined toward a longitudinal axis of the vane or being inclined toward it by no more than 15°;

the vane assembly including a clamping means for clamping the actuating means against the first engagement surface, wherein the clamping means is a wedge that is advanced in a clamp direction forming an angle of less than 45° with the longitudinal axis of the vane to force the actuating means and the first engagement surface against each other and thereby secure the actuating means to the first engagement surface.

* * * * *